US010267499B2

(12) United States Patent
Zhou

(10) Patent No.: US 10,267,499 B2
(45) Date of Patent: Apr. 23, 2019

(54) WALL LAMP WITH VARIABLE ILLUMINATION DIRECTION

(71) Applicant: DONGGUAN THAILIGHT SEMICONDUCTOR LIGHTING CO., LTD, Dongguan (CN)

(72) Inventor: Wenbo Zhou, Dongguan (CN)

(73) Assignee: DONGGUAN THAILIGHT SEMICONDUCTOR LIGHTING CO., LTD, Dongguan (CN)

( * ) Notice: Subject to any disclaimer, the term of this patent is extended or adjusted under 35 U.S.C. 154(b) by 0 days.

(21) Appl. No.: 15/680,254

(22) Filed: Aug. 18, 2017

(65) Prior Publication Data

US 2018/0051868 A1 Feb. 22, 2018

(30) Foreign Application Priority Data

Aug. 18, 2016 (CN) ..... 2016 2 0902420 U

(51) Int. Cl.

| | |
|---|---|
| ***F21V 29/00*** | (2015.01) |
| ***F21V 21/14*** | (2006.01) |
| ***F21V 17/02*** | (2006.01) |
| ***F21V 17/10*** | (2006.01) |
| ***F21S 8/00*** | (2006.01) |
| ***F21V 21/30*** | (2006.01) |
| *F21V 29/76* | (2015.01) |
| *F21Y 115/10* | (2016.01) |
| *F21V 15/01* | (2006.01) |
| *F21V 23/02* | (2006.01) |

(52) U.S. Cl.

CPC ..... *F21V 21/14* (2013.01); *F21S 8/033* (2013.01); *F21V 17/02* (2013.01); *F21V 17/107* (2013.01); *F21V 21/30* (2013.01); *F21V 15/01* (2013.01); *F21V 23/02* (2013.01); *F21V 29/76* (2015.01); *F21Y 2115/10* (2016.08)

(58) Field of Classification Search

CPC ..... F21V 21/14; F21V 17/02; F21V 17/017; F21V 21/30; F21V 29/76; F21V 15/01; F21V 23/002; F21S 8/033; F21Y 2115/10

USPC ..... 362/373

See application file for complete search history.

(56) References Cited

U.S. PATENT DOCUMENTS

| | | | | |
|---|---|---|---|---|
| 2014/0104830 | A1* | 4/2014 | Velazquez | F21V 17/002 362/232 |
| 2017/0234523 | A1* | 8/2017 | Krijn | F21V 33/006 362/145 |
| 2018/0058674 | A1* | 3/2018 | Reynolds | F21V 21/15 |

* cited by examiner

*Primary Examiner* — Karl D Frech
(74) *Attorney, Agent, or Firm* — Gokalp Bayramoglu

(57) ABSTRACT

The invention discloses wall lamp with a variable illumination direction, including lamp beads, a lamp bead seat, a mounting box, and a power adapter. The power adapter is installed within the mounting box; the lamp bead seat is of a cuboid structure, and an accommodating cavity is formed in the cuboid structure, the mounting box is located in the accommodating cavity. The lamp beads are arranged on an outer wall of one side surface of the cuboid structure. A first connector is arranged on an inner side wall of the lamp bead seat, and a second connector is arranged on the mounting box. The first connector is connected to the second connector in a pivotal way. A side surface of the first connector pushes against a side surface of the second connector, so that a level adjusting knob is formed by the mounting box and the lamp bead seat.

9 Claims, 3 Drawing Sheets

WALL LAMP WITH VARIABLE ILLUMINATION DIRECTION

CROSS REFERENCE TO RELATED APPLICATIONS

This application is based upon and claims priority to Chinese Patent Application No. CN201620902420.3, filed on Aug. 18, 2016, the entire contents of which are incorporated herein by reference.

TECHNICAL FIELD

The invention relates to the field of illumination, particularly to a wall lamps with a variable illumination direction.

BACKGROUND OF THE INVENTION

It is extremely inconvenient to mount and dismount existing wall lamps, particularly a street lamp, an industrial mining lamp, a stage lamp, etc. A common wall lamp is provided with a power adapter. To protect the power adapter, a wall lamp is usually installed in a closed space, and mostly installed within the lampshade. Therefore, it is very inconvenient to mount, and dismount the wall lamp. After the wall lamp is fixed to the wall, a power supply needs to be connected to the wall lamp. The old installation method suggests to connect a power supply first and then the lamp is fixed on the wall. This method of installation is extremely inconvenient. The wall lamp may easily slip during the installation process. This slippage may cause damages. Further, the connected power line may fall off as a result of slippage of the lamp body. The fall of the power line may lead to a potential safety hazard. Moreover, in an existing wall lamp, the illumination direction of the lamplight cannot be adjusted arbitrarily after installation. This is an undesirable effect of the current method of installation. Therefore, there is a need for a wall lamp, which can easily be mounted and dismounted and can be easily adjusted in terms of the light path direction.

SUMMARY OF THE INVENTION

To overcome the deficiencies of the prior art, the objective of the present invention is to provide a wall lamp capable of illuminating in a variable direction, which is achieved by arranging a mounting box and a lamp bead seat of a cuboid structure in a pivotal mode to form a level adjusting knob, so that the illumination direction of the wall lamp can easily be adjusted.

The objective of the present invention is realized by the following technical solutions:

A wall lamp with a variable illumination direction includes a plurality of lamp beads, a lamp bead seat, a mounting box, and a power adapter. The power adapter is installed within the mounting box. The lamp bead seat is of a cuboid structure. An accommodating cavity is formed in the cuboid structure. The mounting box is located in the accommodating cavity. The plurality of lamp beads are arranged on an outer wall of one side surface of the cuboid structure. A first connector is arranged on an inner side wall of the lamp bead seat, and a second connector arranged on the mounting box. The first connector is connected to the second connector in a pivotal way. A side surface of the first connector pushes against a side surface of the second connector, so that a level adjusting knob is formed by the mounting box and the lamp bead seat. The level adjusting knob is configured to adjust the illumination direction of the wall lamp.

Preferably, the mounting box includes a box body and a box cover. The box cover is connected to one side of the box body in a pivotal way such that a hinge structure is formed by the box cover and the box body. The box cover is separate from the other side of the box body to open the mounting box, or the box cover is fixed to the other side of the box body to close the mounting box to form a closed cavity structure. Since the box body is connected to the box cover in a pivotal way, and mounting holes are formed in the box cover, and the power adapter is arranged in the mounting box, the wall lamp can easily and safely to be mounted and dismounted.

Preferably, the lamp beads are LED lamp beads. The LED lamp beads produce little heat and save electricity.

Preferably, cooling fins are arranged on an inner side thee of the lamp bead seat. The cooling fins are arranged for dissipating heat generated by the lamp beads, so that the lamp beads and the wall lamp are prevented from being damaged due to excessively high temperature.

Preferably, the cooling fins and the lamp bead seat are integrally formed. The integrally-formed structure of the cooling fins and the lamp bead seat can enhance the heat dissipation and the deformation resistance of the device as well.

Preferably, a plurality of mounting holes for mounting the wall lamp are formed in the box cover.

Preferably, a side surface of the lamp bead seat where the lamp beads are mounted, is recessed towards an interior of the cuboid structure to form a rectangular groove. The lamp beads are installed in the rectangular groove. The arrangement can prevent the rainwater from being directly adhered to the lamp beads in rainy days to influence the illumination effect, and also prevent the falling object from smashing the lamp beads.

Compared to the prior art, the beneficial effects of the present invention are as listed below:

1. The present invention provides a level adjusting knob formed by arranging a mounting box and a lamp bead seat of a cuboid structure in a pivoting mode, so that the illumination direction of the wall lamp is easy to be adjusted, and thus the wall lamp capable of illuminating in a variable direction is provided.

2. Cooling fins are arranged on the lamp bead seat, and the LED lamp beads with little heat production are adopted, such that the temperature of the wall lamp is effectively prevented from rising, and the service life of the wall lamp is prolonged.

3. The integrally formed cooling fins are adopted, and meanwhile, the side surface of the lamp bead seat where the lamp beads are located is recessed inwards to form a rectangular groove. Thus, the rain, dust and other substances can be effectively prevented from contaminating the lamp beads to influence the illumination. Moreover, the lamp beads are protected from falling objects.

Figure 1:
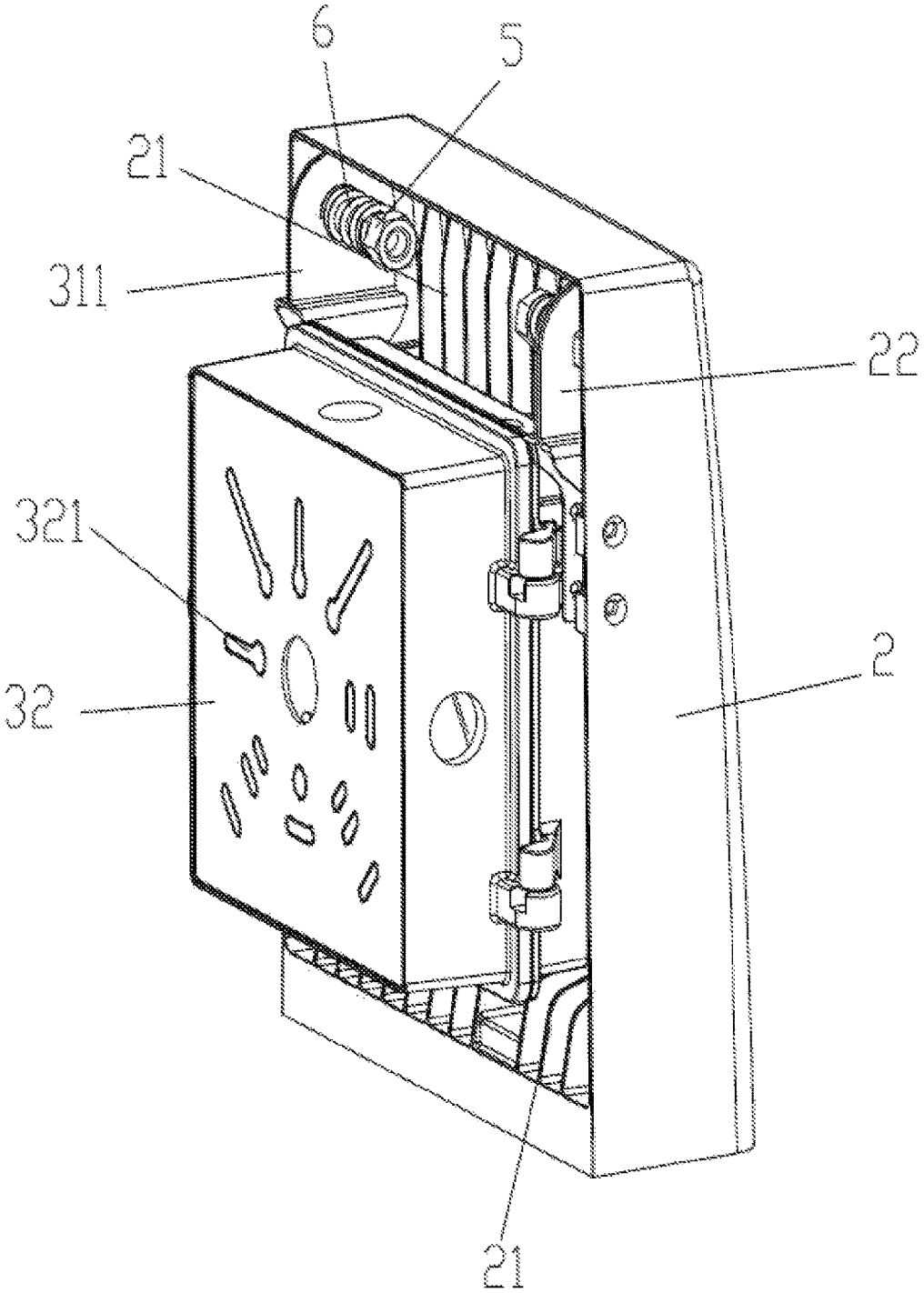
FIG. 1 is a structural schematic diagram of a wall lamp of the present invention.

In the drawings, 1, Lamp bead, 2, Lamp bead seat; 21, Cooling fin; 22, First connector; 3, installation box; 31, Box body; 311, Second connector; 32, Box cover; 321, Installing hole 4, Power adaptor; 5, Bolt; 6, Spring.

DETAIL DESCRIPTION OF THE EMBODIMENTS

With reference to the accompanying drawings and embodiments, the present invention is further illustrated as below.

Figure 2:
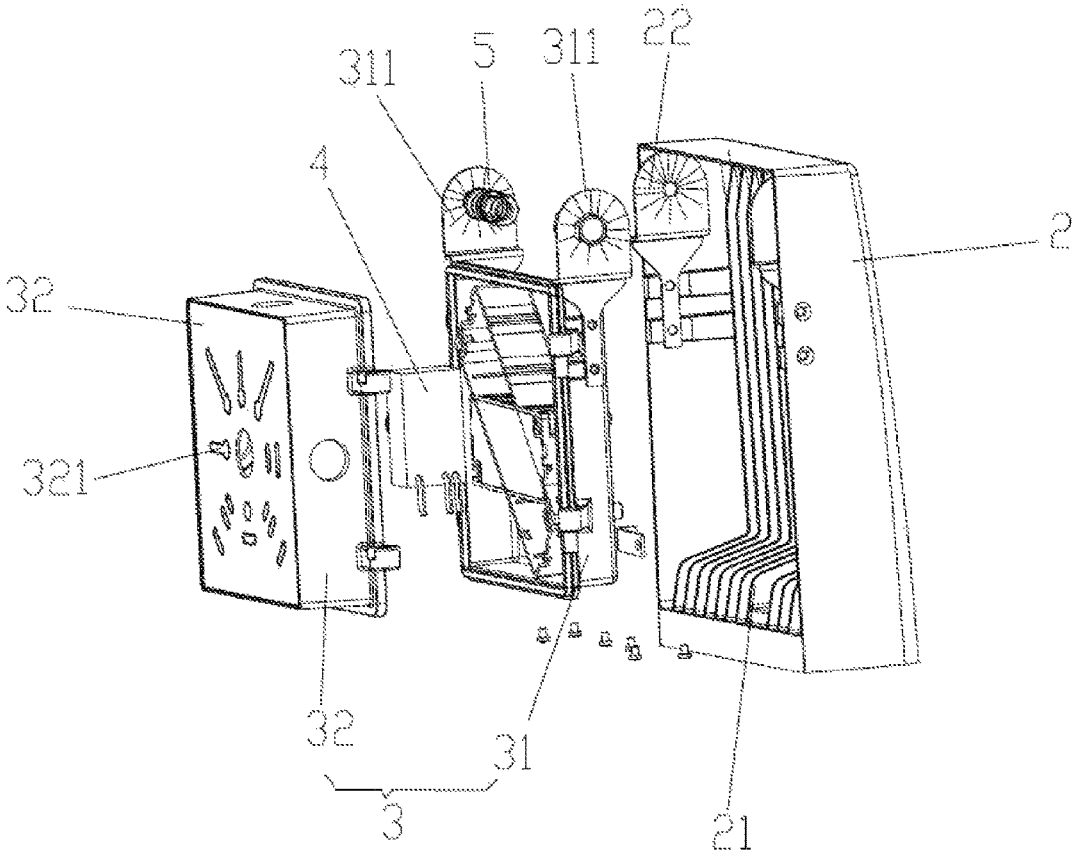
FIG. 2 is an exploded view of the wall lamp of the present invention.
Figure 3:
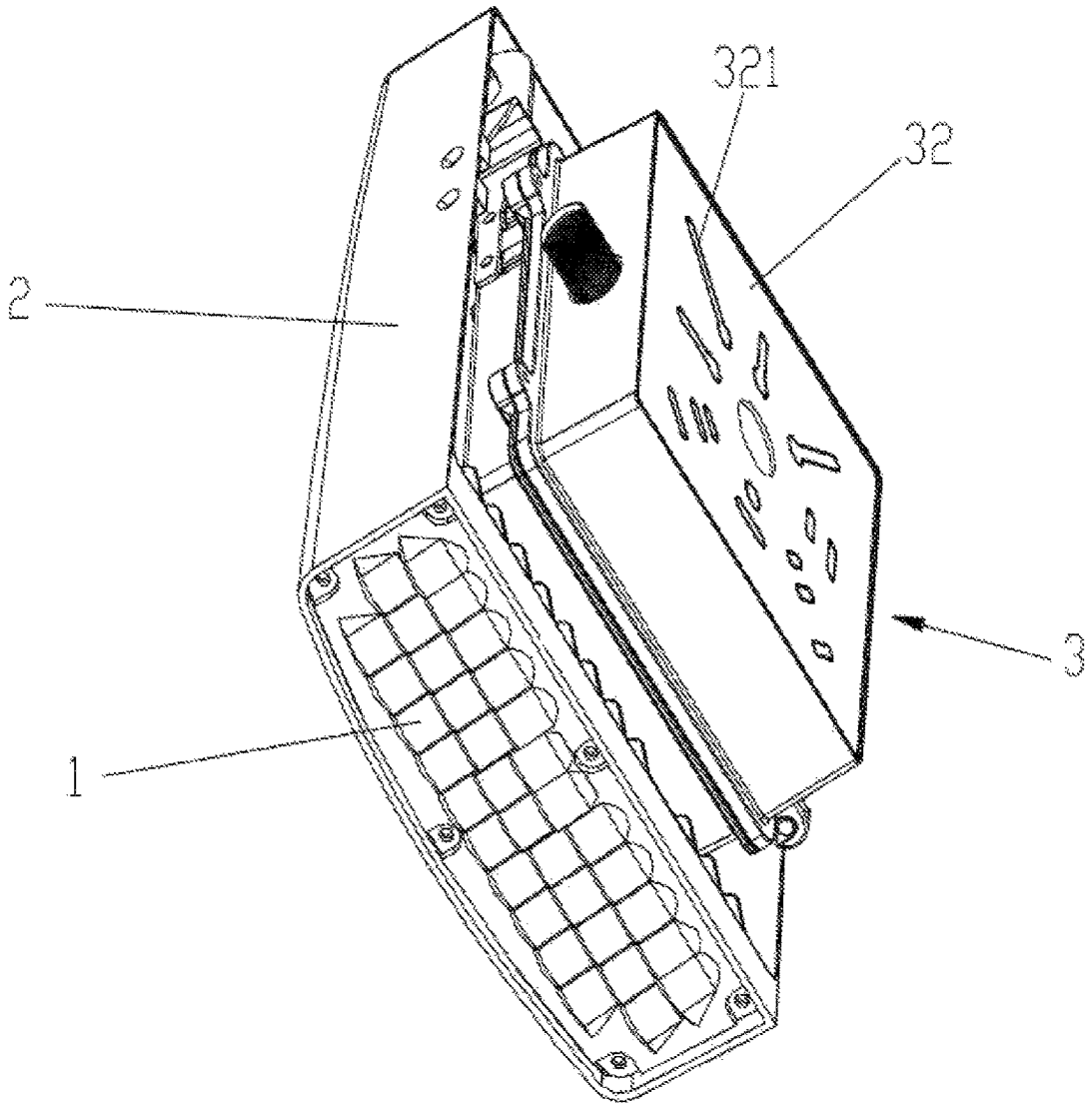
FIG. 3 is a structural schematic diagram of a wall lamp of the present invention from another perspective.

Embodiment 1:

As show as shown in FIG. 1-3, a wall lamp with a variable illumination direction includes lamp beads 1 and lamp bead seat 2, mounting box 3, and power adapter 4. The mounting box 3 includes box body 31 and box cover 32. The power adapter 4 is used for supplying power for the lamp beads 1 and installed within the mounting box 3. The lamp bead seat 2 is of a cuboid structure, and an accommodating cavity is formed in the cuboid structure. The lamp beads 1 are arranged on the outer wall of one side surface of the cuboid structure. The lamp beads 1 are LED lamp beads. The LED lamp beads produce little heat and save electricity. The mounting box 3 is located in the accommodating cavity of the lamp bead seat 2. First connector 22 is arranged on the inner side wall of the lamp bead seat 2, and second connector 311 is arranged on the mounting box 3. Through holes are formed in both the first connector 22 and the second connector 311, and bolt 5 penetrates through the through holes such that the first connector 22 is connected to second connector 311 in a pivotal way. Spring 6 is annularly sleeved on the screw rod of the bolt 5. One end of the spring 6 pushes against the screw cap of the bolt 5, and the other end of the spring 6 pushes against one side face of the second connector 311, so that the side face of the first connector 22 pushes against the other side face of the second connector 311, and thus friction force is generated. A protrusion matched with the notch in the second connector 311 is arranged on the first connector 22. The protrusion is used for further increasing the friction force and ensuring the rotating angle. Thus, the installing box 3 and the lamp bead seat 2 finally form a level adjusting knob, which is used for adjusting the illumination direction of the wall lamp. The box cover 32 is connected to one side of the box body 31 in a pivotal way such that a hinge structure is formed by the box cover 32 and the box body 31. The box cover 32 is separate from the other side of the box body 31 or fixed to the other side of the box body 31. A plurality of mounting holes 321 for mounting the wall lamp are formed in the box cover 32. Cooling fins 21 are arranged on the inner side face of the lamp bead seat 2. Cooling fins 21 are used for dissipating the heat generated by lamp beads 1, so that the lamp beads 1 and the wall lamp are prevented from being damaged due to excessively high temperature. The cooling fins 21 and the lamp bead seat 2 are integrally formed. The integrally-formed structure of the cooling fins 21 and the lamp bead seat 2 can enhance the heat dissipation effect and the deformation resistance of the device as well. The side surface of the lamp bead seat 2 where the lamp beads 1 are mounted, is recessed towards the interior of the cuboid structure to form a rectangular groove. The lamp beads 1 are installed in the rectangular groove. The arrangement can prevent the rainwater from being directly adhered to the lamp beads 1 in rainy days to influence the illumination effect, and also prevent the falling object from smashing the lamp beads 1.

During installation, the box body 31 and the box cover 32 are opened. The box cover 32 is fitted to the mounting position. The wall lamp is fixedly mounted through the mounting holes 321. After the circuit of the wall lamp is connected and tested, the lamp bead seat 2 is rotated towards the box cover 32, so that the box body 31 and the box cover 32 are closed. The closed box body 31 and the box cover 32 are fixedly connected through screws to complete the installation. The operations are beneficial for installation of the wall lamp and the maintenance in the future, and effectively prevent damage or accidents caused by sliding of the wall lamp when mounting, dismounting, or overhauling the wall lamp. During use, the lamp bead seat 2 is rotated around the bolt 5, so that the included angle between the lamp bead seat 2 and the mounting box 3 is changed to change the illumination direction. Under the action of the spring 6, the side face of the first connector 22 pushes against the side face of the second connector 311 and thus friction is generated to prevent the included angle between the lamp bead seat 2 and the mounting box 3 from changing. Thus, stable control of the illumination direction is realized.

For those skilled in the art, various corresponding changes and modifications can be made to the above-mentioned technical solutions and concepts thereof, and all the changes and the modifications shall fall within the protection scope of the appended claims of the present invention.

What is claimed is:

1. A wall lamp with a variable illumination direction, comprising:

a plurality of lamp beads, a lamp bead seat, a mounting box, a bolt with a screw cap, a spring, and a power adapter;

wherein the power adapter is installed within the mounting box;

the lamp bead seat is of a cuboid structure;

an accommodating cavity is formed in the cuboid structure;

the mounting box is located in the accommodating cavity;

the plurality of lamp beads are arranged on an outer wall of one side surface of the cuboid structure;

a first connector is arranged on an inner side wall of the lamp bead seat;

a second connector is arranged on the mounting box;

the first connector is connected to the second connector in a pivotal way through the bolt;

the spring is annularly sleeved on the bolt;

one end of the spring pushes against the screw cap of the bolt, the other end of the spring pushes against one side face of the second connector so that a side surface of the first connector pushes against the one side surface of the second connector, so that an adjusting structure is formed by the mounting box and the lamp bead seat; and the adjusting structure is configured to adjust the illumination direction of the wall lamp.

2. The wall lamp with a variable illumination direction of claim 1, wherein the mounting box includes a box body and a box cover;

the box cover is connected to one side of the box body in a pivotal way such that a hinge structure is formed by the box cover and the box body;

the box cover is separate from an other side of the box body to open the mounting box, or the box cover is fixed to the other side of the box body to close the mounting box to form a closed cavity structure.

3. The wall lamp with a variable illumination direction of claim 2, wherein a plurality of mounting holes for mounting the wall lamp are formed in the box cover.

4. The wall lamp with a variable illumination direction of claim 1, wherein the plurality of lamp beads are LED lamp beads.

5. The wall lamp with a variable illumination direction of claim 1, wherein cooling fins are arranged on an inner side face of the lamp bead seat.

6. The wall lamp with a variable illumination direction of claim 5, wherein the cooling fins and the lamp bead seat are integrally formed.

7. The wall lamp with a variable illumination direction of claim 1, wherein a side surface of the lamp bead seat where the plurality of lamp beads are mounted, is recessed towards an interior of the cuboid structure to form a rectangular groove; and the plurality of lamp beads are installed in the rectangular groove.

8. The wall lamp with a variable illumination direction of claim 1, wherein the first connector and the second connector each defines a through hole, and the bolt penetrates through the through holes such that the first connector is connected to the second connector.

9. The wall lamp with a variable illumination direction of claim 1, wherein a notch is arranged in the second connector, a protrusion matched with the notch is arranged on the first connector.

* * * * *